US005148208A

United States Patent [19]

Klosterboer et al.

[11] Patent Number: 5,148,208

[45] Date of Patent: Sep. 15, 1992

[54] DISPOSABLE CONTAINER FOR DISPENSING OF PHOTOGRAPHIC DEVELOPING LIQUIDS

[75] Inventors: Donald H. Klosterboer, Escondido; Jerry M. Owens; Aubrey E. Thompson, both of San Diego, all of Calif.

[73] Assignee: Anacomp, Inc., Atlanta, Ga.

[21] Appl. No.: 556,124

[22] Filed: Jul. 20, 1990

[51] Int. Cl.[5] ..... G03D 3/02

[52] U.S. Cl. ..... 354/324; 354/336; 222/146.2; 222/318; 222/564; 222/464

[58] Field of Search ..... 222/54, 146.1, 146.2, 222/146.5, 318, 372, 405, 424, 464, 564; 137/583, 341; 239/124–127; 354/323, 324, 336, 299, 297, 325–327

[56] References Cited

U.S. PATENT DOCUMENTS

| | | | |
|---|---|---|---|
| 3,042,265 | 7/1962 | Rodth | 222/146.5 |
| 3,147,366 | 9/1964 | Dreyfoos | 354/324 X |
| 3,190,321 | 7/1965 | Robinson | 137/563 X |
| 3,197,076 | 7/1965 | Chamblee | 222/146.5 |
| 3,644,024 | 2/1972 | Downey | 354/336 |
| 3,904,086 | 9/1975 | Losenno | 222/146.5 |
| 3,933,276 | 1/1976 | Packham et al. | 222/146.5 |
| 3,986,191 | 10/1976 | Ackermann et al. | 354/324 X |
| 4,011,992 | 3/1977 | Olsen | 222/146.2 X |
| 4,133,456 | 1/1979 | Corini | 222/146.5 |
| 4,349,267 | 9/1982 | Ohtani | 137/563 X |
| 4,494,569 | 1/1985 | Tagnon et al. | 137/563 |
| 4,533,225 | 8/1985 | Shiga | 354/324 X |
| 4,856,683 | 8/1989 | Beaston | 222/318 |
| 4,958,666 | 9/1990 | Kocourek et al. | 354/324 X |

*Primary Examiner*—Kevin P. Shaver
*Assistant Examiner*—Kenneth DeRosa
*Attorney, Agent, or Firm*—Dressler, Goldsmith, Shore, Sutker & Milnamow, Ltd.

[57] ABSTRACT

A disposable container in the shape of a bottle made of molded polyethylene plastic serves as a reservoir for a photographic development liquid, that is circulated between the container's reservoir and a machine. The container has large planar sides to which good thermal contact is made by electrical heating pads for the purpose of heating the liquid within the container's reservoir. A substantially planar top surface of the container defines a central outlet aperture. This aperture connects to a feed tube which extends into the container's reservoir. The container is mounted upright to the machine's bottom surface by a screw collar. The machine's bottom surface is complementary to, and mates with, the container's top surface. A fluid-tight compressive seal is made in a first annular region about the container's central aperture by means of an O ring or gasket. A second annular section of the container's top surface includes a number of inlet orifices through which circulating fluid is returned to the container's reservoir, and through which gases are vented. Another fluid-tight compressive seal is made (also by means of an O ring or gasket) at an outermost annular section of the container's top surface. Circulating fluid enters the container through its inlet orifices and flows down internal baffles within the container to the reservoir in a continuous path that inhibits dripping and resultant fluid oxidation. A disposable filter, preferably porous polyethylene, is located where the bore of the feed tube opens into the container's reservoir.

26 Claims, 6 Drawing Sheets

FIG. 1
PRIOR ART
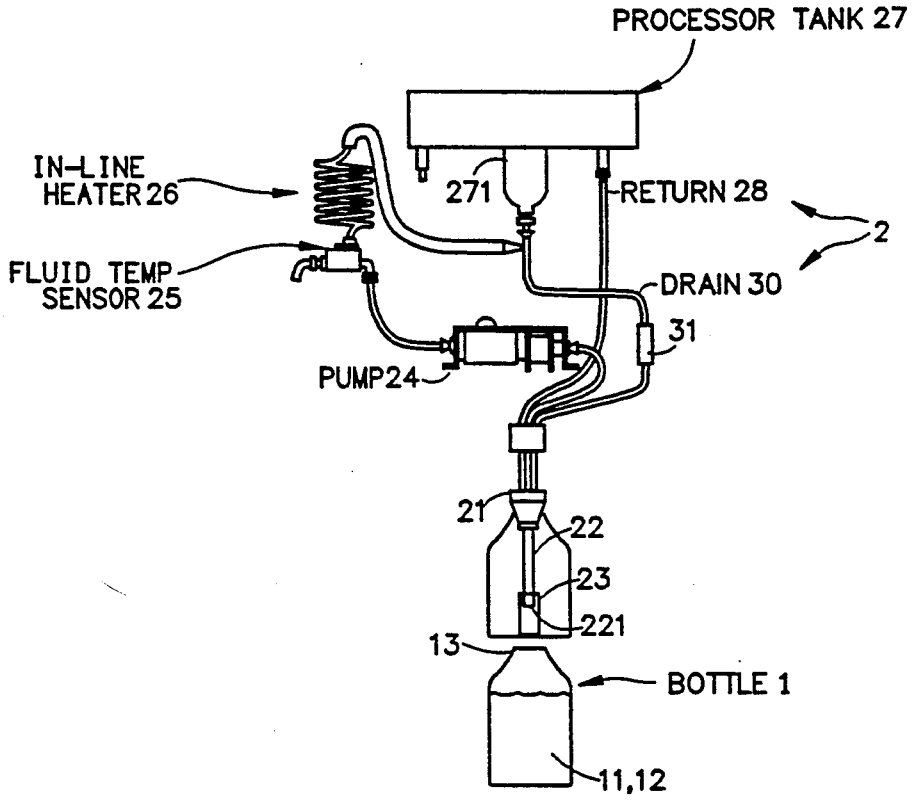
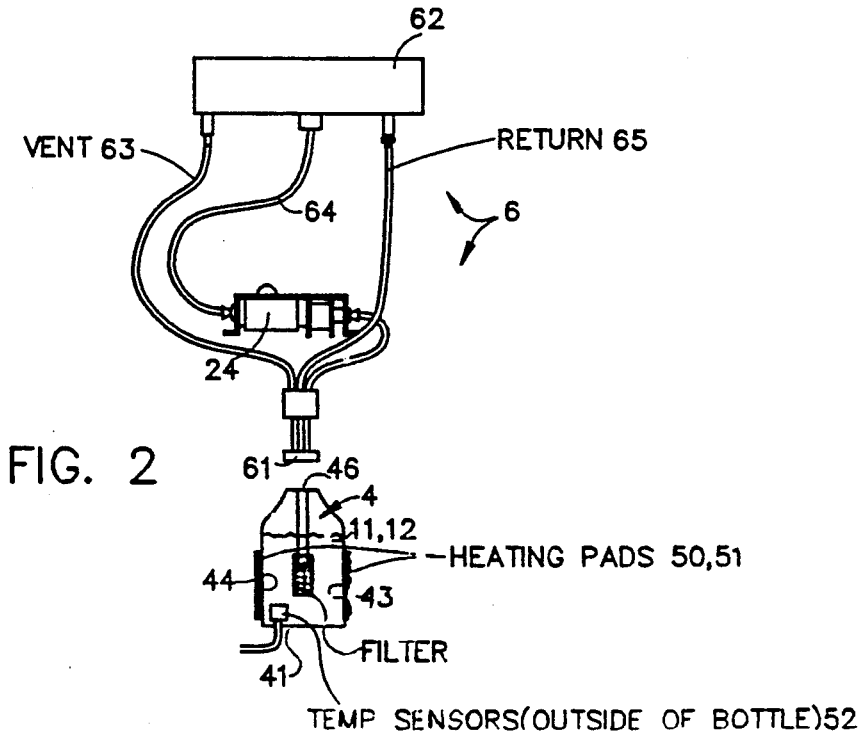
FIG. 2

DISPOSABLE CONTAINER FOR DISPENSING OF PHOTOGRAPHIC DEVELOPING LIQUIDS

BACKGROUND OF THE INVENTION

1. Field Of The Invention

The present invention concerns containers used for holding, and dispensing, photographic developing liquids, particularly heated fluid developer, within and to a machine that develops photographs, particularly microfilm.

2. Background Of The Invention

Various modern machines develop photographs in an automated, or semi-automated, process. The liquid chemicals used in the photographic development process, including fluid developer, are consumed during the machine process of photographic development. These consumable liquid chemicals must be (i) delivered fresh to the machine, (ii) circulated during the photographic development process within the machine, and (iii) extracted from the machine when spent. The delivery is normally periodic as required, in bottles.

One particular machine that uses photographic chemicals in an automated photographic development process is a computer output on microfilm (COM) machine that images, and develops, microfilm. Previous containers, and plumbing, for the delivery of liquid photographic chemicals to COM and other machines have characteristically been both cumbersome and problemsome.

In one particular COM machine made by the assignee of the present invention—which machine functions commensurately with many other machines using liquid photographic chemicals to develop photographs—liquid photographic chemicals are delivered to the machine in capped cylindrical plastic bottles. The caps of such bottles are removed, and a takeup tube by which the liquid chemicals are extracted from the bottle to the machine is inserted through the neck of the bottle. A return fluid path is also provided from the machine into the bottle so that excess liquid chemical recycled from photographic development process may be returned to the bottle. This path also typically proceeds through a tube—the return tube—that extends from the machine through the neck of the bottle into a space above the bottle's liquid reservoir. The liquid photographic chemical typically circulates in a continuous loop that includes a reservoir of chemical within the bottle.

Each liquid photographic chemical is normally filtered during the course of its circulation.

At least one liquid photographic chemical—fluid developer—is also normally heated during the course of its circulation. The heating of fluid developer is done so that it may be raised to, and maintained at, an optimum temperature for use in the photographic development process.

The heating is typically accomplished by electrically resistive heating elements located in-line the fluid flow path. The fluid developer, which is mildly corrosive, must not be allowed to cause shorts in the resistive heating elements. Accordingly, the heating elements are normally required to be made from a non-corroding metal in order to improve their service life and reliability. Problems with such heating elements include that they are typically expensive, hard to clean, and subject to clogging.

Another problem is oxidation of the fluid developer. It is well known that fluid developer is prone to oxidation from contact with air. The oxidation impairs the chemical suitability of the developer. Ordinarily the fluid developer is continuously circulated in order that it may be heated and ready for use during the development process. This continuous circulation agitates the fluid developer, exposing it to air and causing it to undergo oxidation at an increased rate.

Still another problem with previous bottle is that they have proven cumbersome and hazardous during interchange. When the takeup and return tubes are withdrawn from the neck of a spent bottle they typically drip copious amounts of liquid chemical. The dripped chemical tends to get on the external surface of the bottle, and from there onto the hands and clothing of a human. The chemical may also accumulate on the floor of the machine. Fluid developer, in particular, is a skin irritant that stains clothing. Interchange of bottles has not only proved to be a messy operation, but hazardous as well, with possible contamination of the environment.

Yet another problem arises when a filter within a fluid circulation line must be changed. The fluid takeup and return tubes are typically detached from the machine in order to permit access to the filter. The filter, which is itself saturated with fluid, must then be manually extracted from the machine and either cleaned or replaced. This preventive maintenance task of extracting, and changing or cleaning the filter is not only difficult and messy, but may as well contaminate the environment and/or persons. Because of the difficulty and messiness of the task it is often performed more infrequently than is desireable for maintaining the machine and its fluids in satisfactory operating condition.

Accordingly an improved container/delivery system is needed which would: (i) permit heating of circulating fluid developer without the use of expensive non-corroding heating elements, (ii) reduce the oxidation of fluid developer occurring from and during its continuous circulation, (iii) reduce or eliminate personal and environmental contamination from spilled fluids, (iv) improve the ease and reliability of connecting containers of liquid chemical to a machine, and (v) improve preventive maintenance by promoting the cleaning or substitution of fluid filters.

SUMMARY OF THE INVENTION

The present invention contemplates an anti-spill, anti-drip, externally-heatable, internally-filtered, oxidation-inhibiting, disposable container for delivering a liquid to a machine, and for storing the liquid, as a reservoir, during closed-loop circulation of the liquid within and by the machine. The liquid may be a photographic development chemical or other mildly corrosive liquid such as fluid developer.

The present invention further contemplates a system for the heating of a circulating liquid photographic chemical, particularly fluid developer. The fluid developed is heated within a reservoir, and circulated between the reservoir and a machine. Because the fluid developer is heated within a reservoir, and more particularly within an interchangeable container that is normally in the form of a plastic bottle, it need not be continuously circulated in order to be maintained at an appropriately elevated temperature for immediate use in a photographic development process. Because the fluid developer is only intermittently circulated, its oxidation is reduced, and its useful life is prolonged.

In its preferred embodiment, a container in accordance with the invention is configured as an upstanding, top openable, capped bottle substantially in the shape of a regular parallelepiped body. During use to supply liquid to a machine, the bottle is uncapped, and is placed at a suitably sized and contoured rest within the machine. The bottle is secured from spilling at its position on the machine's rest.

The bottle presents at least one, and preferably two, exterior surfaces (preferably two side surfaces) that are contoured for making good contact with one or more substantially planar heated surfaces, typically two heating pads, that are external to the bottle at the rest of the machine. The side surfaces are pressed flat against the heating pads when the bottle is filled with liquid and placed at the rest position.

At still another exterior surface of the bottle, typically at a remaining side and more typically at a planar back side, the bottle is pressed into thermal contact with one or more temperature-sensing elements, typically an integrated circuit temperature sensor chip. Each of the two heating pads and the temperature sensor chip may be spring loaded so as to be pressured into good thermal contact with the side surfaces of the bottle.

The liquid (fluid developer) in the bottle is evenly heated to a prescribed temperature by thermal conduction from the heating pad(s), and its temperature is monitored by the temperature-sensing element. The intermittent circulation the heated fluid developer to and from the machine is only as required, and is even then by a direct path. Accordingly, the heated fluid developer incurs little thermal loss. The direct circulation of the heated fluid developer only during machine operation for photographic development considerably reduces oxidation over what would accrue if the fluid developer was to be continuously circulated, including during standby periods, and/or was to be circulated by an indirect path.

Further, in accordance with the present invention, the bottle includes an integral upper surface. When the bottle's cap is removed and the bottle is attached to the machine, this upper surface serves as a mating surface for bidirectional transfer of liquids therebetween. The bottle's upper surface is typically round and flat, about 5 to 6.35 centimeters (2" to 2¼") in diameter, made of plastic, and sealed to the plastic bottle.

The bottle's upper surface defines (i) a central aperture, (ii) a first annular section, located about the central aperture, having an outer surface contour to which a first fluid-tight compressive seal may be made, (iii) a second (next outermost) annular section having one or more orifices, and (iv) a third (next outermost) annular section having an outer surface contour to which a second fluid-tight compressive seal may be made. When the bottle is mounted for fluid interchange with a machine, fluid-tight compressive seals are made to the first and third annular sections of the upper surface, typically by action of elastomeric O rings or a gasket.

Through the action of a connector (normally a screw collar), the mating surface of the bottle (its upper surface) is made to mate tightly with a complementary, substantially planar mating surface of the machine (its lower surface), forming a fluid-tight seal. Because both mating surfaces are substantially planar, when the bottle is removed from the machine neither it nor the machine drips fluid.

A feed tube located within the bottle forms a conduit for fluid flowing between a central aperture of the bottle's upper surface and the reservoir of the bottle.

Both fluid and vent gases are returned from the machine to the bottle through separate orifices within the second annular section of the bottle's upper surface. The separation of the paths of the fluid returning to the reservoir and the vent gases (both of which—fluid and gases—normally flow under force of gravity) reduces the mixing of fluid and oxidizing gases. The separated return paths also promote a smooth and continuous fluid flow. Because of the dual return paths the returning fluid is not continuously intermixed with oxidizing gases, nor is it agitated so as to form bubbles. Accordingly, unwanted oxidation of the fluid is diminished.

The interior of the bottle preferably incorporates one or more baffles. The baffles are normally of triangular shape, and typically extend downwards from the underside of the bottle's upper surface (below the orifices of at least a first half of the second annular section) to the exterior wall of the bottle's feed tube. The baffles are positioned immediately below the orifices where fluid is received back into the bottle from the machine under force of gravity. The downward-flowing fluid enters the orifices in the first half of the second annular section of the bottle's upper surface, runs smoothly down the baffles to the exterior surface of the tube, and flows smoothly down the exterior surface of the tube into the reservoir at the bottom of the bottle. This smooth and continuous pathway avoids any dripping of the fluid through air within the bottle, and correspondingly also serves to reduce oxidation of the circulating fluid.

A filter is preferably located inside the bottle and within the fluid path, in a position between the inlet orifice and the central outlet aperture of the bottle's upper surface. The filter is preferably porous polyethylene plastic located around the lower opening to the bore of the bottle's central feed tube. The filter is disposable along with the bottle, which is preferably made of molded polyethylene plastic.

The bottle also has a threaded upper exterior rim. To mount the bottle to the machine, a screw collar or ferrule (which is rotatably affixed to the machine by a flange) is rotated about the upper exterior rim, thereby securing the bottle to the machine.

These and other aspects and attributes of the present invention will become increasingly clear upon reference to the following drawings and accompanying specification.

BRIEF DESCRIPTION OF THE DRAWINGS

FIG. 1 is a diagrammatic representation of a prior art system for circulating liquids between a liquid reservoir within a bottle and a machine, and for heating the liquid during its circulation.

FIG. 2 is a diagrammatic representation showing the applications' environment of a disposable container in accordance with the present invention.

DETAILED DESCRIPTION OF THE INVENTION

Figure 3B:
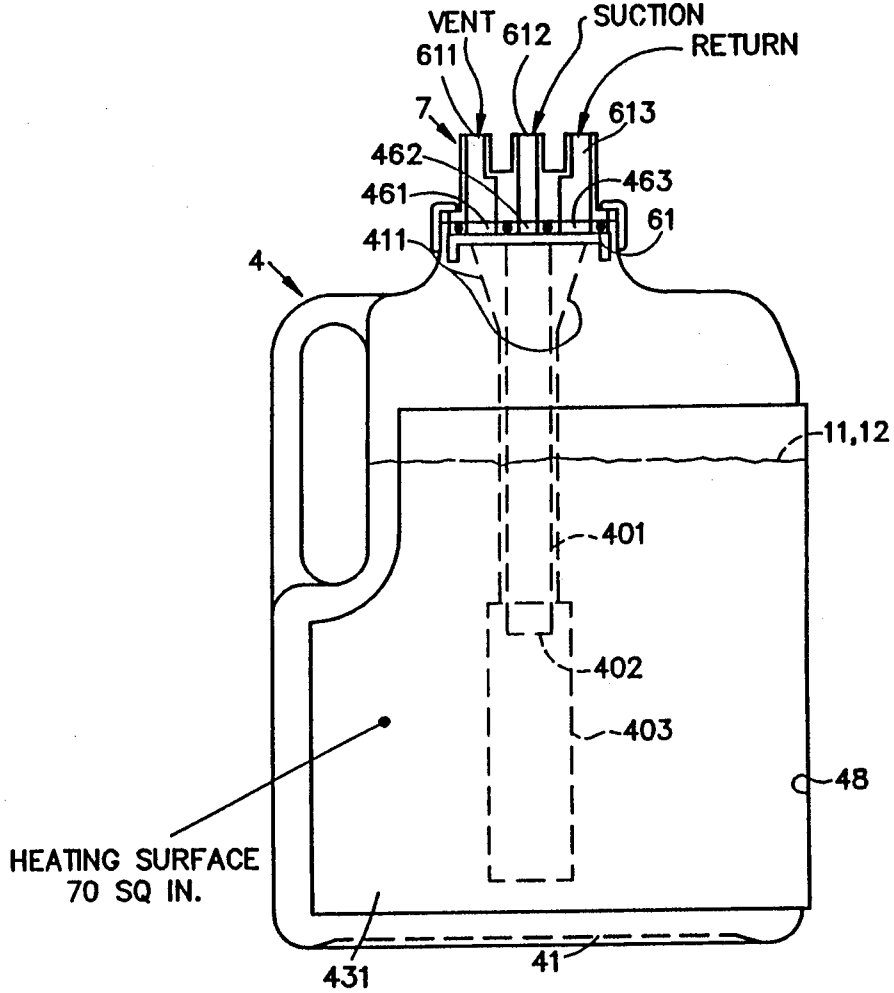
FIG. 3, consisting of FIG. 3*a* and FIG. 3*b*, are front and side views, partially cutaway, of a preferred embodiment of a disposable container in accordance with the present invention.

The present invention is embodied in a container, and a system, for dispensing and circulating liquids, particularly photographic developing liquids and more particularly fluid developer, between a liquid reservoir defined by the container and a machine, particularly a machine that develops photographs.

An exemplary prior art system for the delivery of a liquid in a container to a machine, and for the circulation of the liquid between the machine and the container, is diagrammatically shown in FIG. 1. An exemplary bottle 1, which may be one of several such bottles, is both mechanically- and flow-connected to a machine 2. The bottle 1 typically contains photographic developing liquid 11, and more typically contains fluid developer 12. The machine 2 develops photographs, for example microfilm.

In use to supply a photographic liquid 11, and particularly fluid developer 12, to machine 2, the bottle 1 is uncapped (cap not shown) and connected to the machine as shown in phantom line. In such connection the neck 13 of the bottle 1 mates with a complementary fitting 21 of machine 2, typically by snap fit or a screw thread. A tube 22 that is permanently connected to fitting 21, and thus also to machine 2, extends downwardly into the liquids 11, 12 that are within the bottle 1. A cleanable or disposable filter 23 is located at or about the lower entrance to the bore 221 of tube 22.

The liquids 11, 12 within the mounted bottle 1 are sucked into machine 2, and circulated therethrough, under force of a pump 24. If the circulated liquid is fluid developer 12, then its temperature is sensed by a fluid temperature sensor 25. In accordance with the sensed temperature, the fluid is heated to an elevated temperature during its passage through in-line heater 26. The heater 26 is normally made from a coil of non-corrosive metal, typically stainless steel, in order that it should not be unduly corroded by the fluid developer 12. The heater 26 is electrically resistive, and is heated by electrical energy from a control circuit (not shown) that is responsive to fluid temperature sensor 25. The heated fluid developer 12 is circulated to processor tank 27 under the pressure force of pump 24. After use in tank 27 the fluid developer 12 is returned to the reservoir within bottle 1 via return line 28.

The tank 27 has a depressed lower region or trough 271. All fluid within the tank 27 may be drained for cleaning the system through drain line 30 when clamp 31 is temporarily opened.

A preferred container in accordance with the present invention, and the environment of its use, is diagrammatically illustrated in FIG. 2. The preferred container is in the shape of bottle 4. It is delivered into use sealed by a cap (not shown), which may be either of the screw-on, press-fit, thermoplastically-sealed, or glued-foil types. In its mounted position, which will be shown in greater detail in FIG. 4, the bottle 4 rests upon its base surface 41. It presents a top, or upper, surface 46 (shown in FIG. 3*a*) in position opposing a bottom surface 61 upon the machine 6. As well as being modified in the area of its bottom surface 61 relative to fitting 21 shown in FIG. 1, the entire machine 6 differs from the previous machine 2 seen in FIG. 1 because it neither includes the fluid temperature sensor 25 nor the in-line heater 26 (both previously seen in FIG. 1). The machine 6 still, however, includes the pump 24, a modified processor tank 62, and modified fluid lines 63, 64, 65.

In the preferred embodiment of the invention shown in FIG. 2 the regulated heating function—previously performed by fluid temperature sensor 25 and in-line heater 26 previously seen in FIG. 1—is now performed by one or more, and preferably one, temperature sensor 52, and by one or more, and preferably two opposed, heating pads 50, 51. The heating pads are normally located exteriorly of and adjacent to the opposite side surfaces 43, 44 of bottle 4.

Figure 5A:
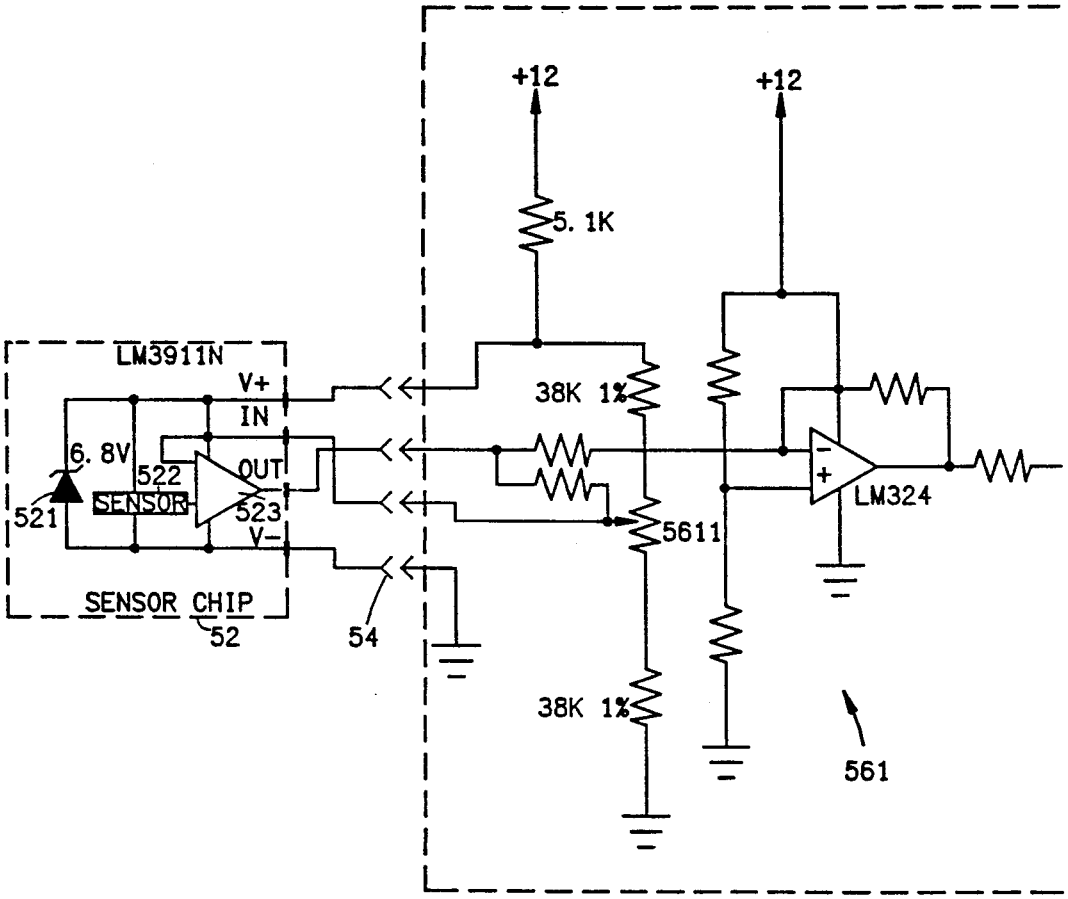
FIG. 5*a* and 5*b* are schematic diagrams showing the preferred embodiment of an electrical circuit for the thermal conductive heating of the fluid contents of a container in accordance with the present invention.
Figure 5B:
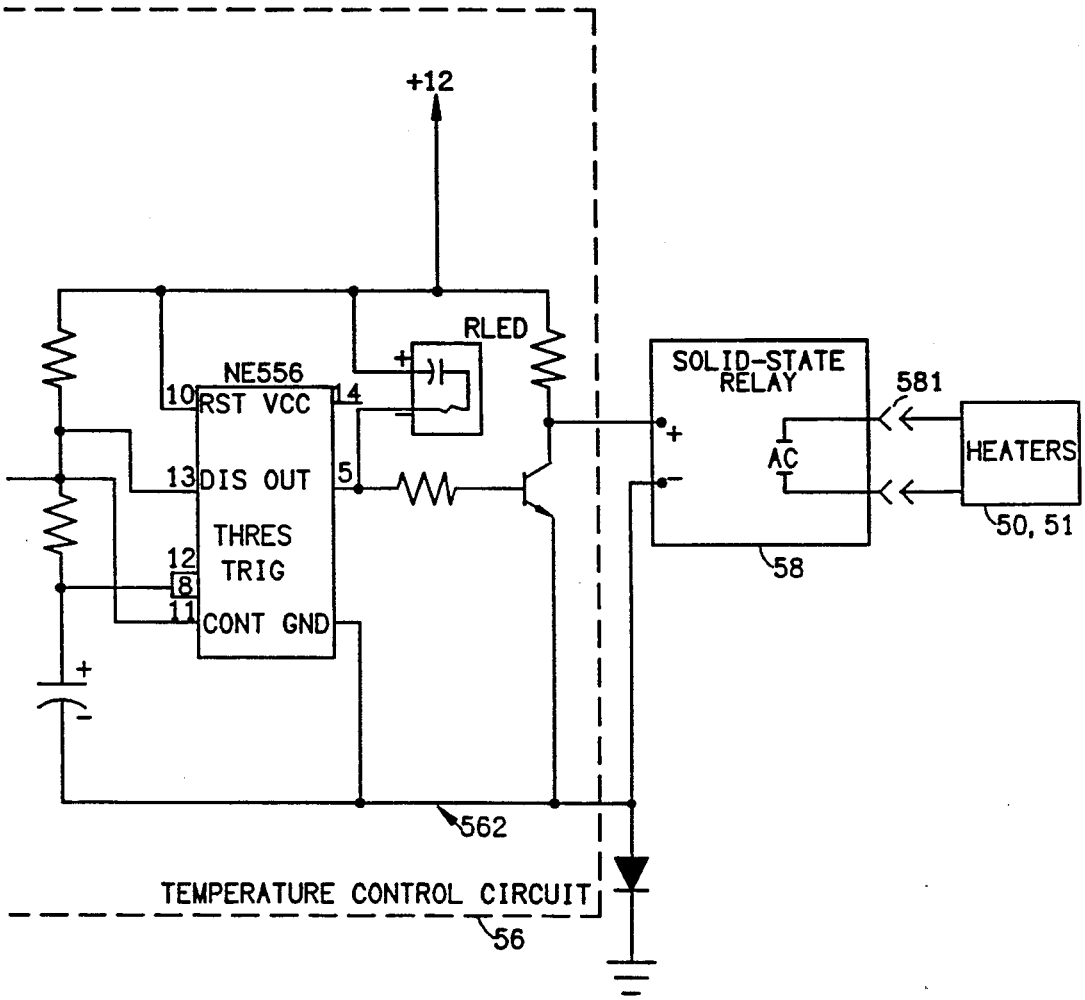

The temperature sensor 52 is used to control energization of the two heating pads 50, 51 by action of the control circuit shown in electrical schematic diagram in FIG. 5. The heating of the liquid 11, particularly fluid developer 12, that is within the bottle 4 by the two heating pads 50, 51 located at the two opposed side surfaces 43, 44, causes the entire liquid contents of the bottle 4 to be heated evenly and reliably.

An optional additional sensor (not shown) may be located on one of each bottle's heating pads 50, 51, and used to sense an over-temperature failure. This optional sensor is not part of the thermal control system, but may be used to signal the machine 4 to shut down due to a possible hazard if an over-temperature condition is sensed.

The fluid developer 12 may become depleted from the bottle 11 over the course of its usage by evaporation, or by migration out of the system on the developed film. The depletion of fluid developer 12 may permit the heating pads 50, 51 to melt the upper part of the bottle, which will eventually be emptied of fluid. Accordingly, in certain adaptations of the fluid heating and circulating system of the present invention for the purpose of heating fluid developer 12, or any other liquid 11, to a very high temperature, two heating pads may be used per bottle side instead of one—a lower pad of high wattage, and an upper pad of low wattage. The total wattage of the heating pads will typically remain the same, and the mechanical configuration will remain the same. In this configuration the upper, low wattage, heating pads will contribute to the overall heating, and to the evenness of such heating, but will never be capable of melting the upper part of the bottle 4, even when the bottle is partially empty.

When positioned for use, the bottle 4 sets upon a rest (not shown) of the machine 6. In its rest position, the bottle is held snugly between opposed heating pads 50, 51. The heat produced by the heating pads is thermally conducted through the thin plastic sides of the bottle 4 in order to heat fluid developer 12 within the bottle. Similarly, the fluid temperature sensor 52 is pressed into good thermal contact with bottle 4 when the bottle is in its rest position. The contact of the temperature sensor 52 and the heating pads 50, 51 with a side of the bottle 4 is facilitated by the flexibility of the bottle's sides coupled with the outward pressure upon these flexible sides by the liquid 12. Each of the heating pads 50, 51 and the temperature sensor 52 is preferably also spring loaded (springs not shown) to be absolutely assured of reliability making good thermal contact with the bottle 4, and with the liquid contents of the bottle.

After being heated, the fluid developer 12 flows through pump 24 and fluid feed line 64 to the processor tank 62. After use in the photographic development process, the circulating fluid developer 12 is returned from processor tank 62 through fluid return line 65 to bottle 4. A third fluid line 63 is ported above the level of the developing fluid 12 within processor tank 62. It serves as a vent for the interchange of gasses between the ullage above the reservoir of developing fluid 12 within the bottle 4, and a similar volume above the level of circulating developing fluid 12 within the processor tank 62. The fluid lines 64, 65, primarily conduct liquids while the fluid line 63 primarily conducts gaseous vapors. All fluid lines 63–65 are characterized by being relatively straight, and in a direct path, between processor tank 62 and bottle 4. The thermal loss occurring in any of the fluid and gas lines 63–65, which may be insulated if desired, is minimal. Because of the general directness of the fluid lines 63–65, fluids of the diverse types, including viscous fluids, may be circulated smoothly and reliably without line blockages, build up of contaminants or deposits, leaks, or other problems.

Figure 3A:
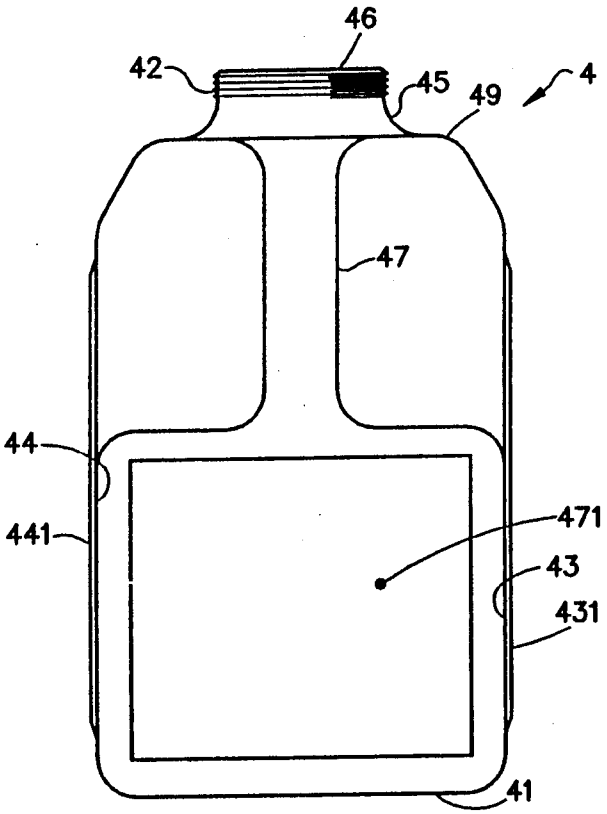

A preferred embodiment of a fluid container in accordance with the present invention, substantially in the shape of a bottle 4 (previously seen in FIG. 2), is shown in front view in FIG. 3*a*, and in side view in FIG. 3*b*. Also shown in FIG. 3*b* (only) is a portion of the bottom surface 61 of the machine 6 to which the bottle 4 connects for the interchange of fluids. The raised surfaces, or walls 431, 441 of the bottle 4 will be in thermal contact with the machine 6 (shown in FIG. 2) when the bottle is located upon a rest (not shown) of the machine 6.

The bottle 4 is typically in the shape of a substantially regular parallelepiped volume of approximately 12.7 centimeters (5 inches) width, by 15.24 centimeters (6 inches) depth, by 17.78 centimeters (7 inches) height to the level of its shoulder 49. A neck region 45, which presents an upper surface 46, is approximately 5 to 6.35 centimeters (2 to 2½ inches) in diameter. The neck region 45 typically rises approximately 0.85 centimeters (⅓ inch) above the level of the shoulder 49. The bottle 4 presents a handle 47, normally integrally molded of plastic, by which it may be conveniently carried, and positioned, with the human hand. The bottle 4 may affix a label 471 in a region below its handle 47.

The bottle 4 is positioned for use in a tight cavity of machine 6 (shown in FIG. 2) that is typically defined by exterior side plates, or walls, which are typically made of metal. The walls of the machine 6 cavity hold the heating pads 50, 51 (previously seen in FIG. 3) in good thermal contact with the sides 43, 44 of bottle 4. The exterior surfaces 421, 441 of sides 43, 44 are raised to promote this good thermal contact. The total area over which thermal contact is made by both of the heating pads 50, 51, in combination, is typically in excess of 450 square centimeters (70 square inches).

Note that the bottle 4 normally has a slightly concave bottom, or base, surface 41. This surface 41 may also be of a slightly irregular contour, as is typical of blow-molded plastic bottles. According to the concave and/or irregular contour of this bottom surface 41, it is preferred that the thermal contact of the bottle 4 and its contents with both the heating pads 50, 51 (shown in FIG. 3), and with the temperature sensor 52 (also shown in FIG. 3), should be made at the broad and substantially planar side surfaces 43, 44, and at the back side surface 48, and not at the bottom surface 41.

As is particularly illustrated in dashed line in FIG. 3*b*, the upper surface 46 to the bottle 4 has openings, or apertures, or orifices at regions 461, 462, 463. For clarity, and for ease of reference, the central opening 462 is called an "aperture" while the peripheral openings 461, 463 are called "orifices".

The central aperture 462 flow connects to a channel or port, 612 within the bottom, mating, surface 61 of a connector 7 of machine 6. Meanwhile, each of the orifices 461, 463 are representative of a number of like orifices exhibiting radial and circumferential symmetry around the central aperture 462, as is most clearly visible in FIG. 4*a*. Typically, particular ones of the orifices 461 and 463 are oppositely radially disposed about central aperture 462, and are located, center to center, at a circumferential separation of about 180°.

At mating surface 61, orifice 461 (located on one 180° circumferential arc about central aperture 462) and orifice 463 (located on the remaining 180° circumferential arc) respectively connect to vent channel or port 611 (and thus to venting fluid line 63 shown in FIG. 2), and to fluid channel or port 613 (and thus to return fluid line 65 shown in FIG. 2).

The top surface 46 (FIGS. 3 and 4*b*) thus presents three separate paths of flow to the interior of bottle 4. The interior defines a reservoir containing liquid 12. The path through central aperture 462 is used for the egress of liquid 12 from the reservoir of bottle 4. The paths through the peripheral orifices 461, 463 are used respectively for the ingress of gases and liquids into the reservoir of the bottle 4.

Further in FIG. 3*b*, an internal feed tube 401 may be observed to extend vertically in a substantially central position within the volume of bottle 4 between the central aperture 462 of the bottle's upper surface 46 and the reservoir of liquids 11, 12 that are within the bottle 4. The lower bore 402 of feed tube 401, which bore 402 is located within the reservoir of liquids 11, 12, is normally surrounded with and occluded by a porous filter 403. The filter 403 is preferably made of porous polyethylene. It serves to filter contaminants from the fluid 11, 12 that is withdrawn from the reservoir of bottle 4 via feed tube 401 and via the central, outlet, aperture 462 of upper surface 46.

Also shown in FIG. 3*b* are the baffles (also referred to as ribs or flow guides) 411. The baffles 411 extend from a region of upper surface 46 below its orifices 461, 463 to the exterior surface of the centrally-located feed tube 401. They channel such fluid as is received into bottle 4 from vent port 611, and especially from return port 613, to the exterior sides of feed tube 401 without requiring such fluid to drip through air. The alleviation of dripping helps to impede oxidation of the fluid developer 12.

The baffles 411 could obviously be alternatively structured, such as by extending directly into the reservoir of liquids 11, 12 within bottle 4 without necessity of intersecting, and interacting, with the feed tube 401. Nonetheless to such alternative constructions, the triangular-shaped baffles 411 that are peripherally arrayed at the top regions of feed tube 401, and below the orifices 461, 463, are preferred for their effectiveness in both channeling fluid and in structurally supporting the feed tube 401.

Figure 4A:
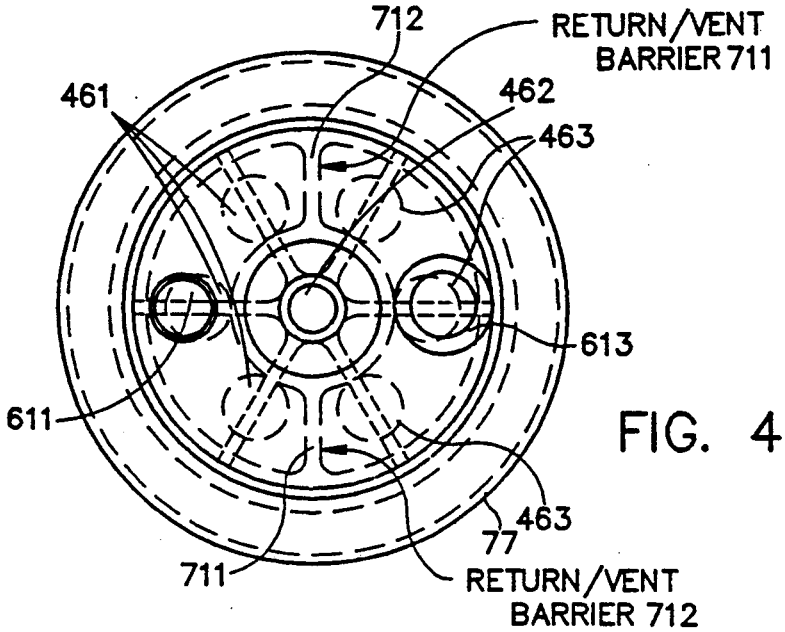
FIG. 4*a* is a cross sectional detail plan view of the mating surfaces of a container in accordance with the present invention, previously seen in FIG. 3, and a machine to which the container mounts.
Figure 4B:
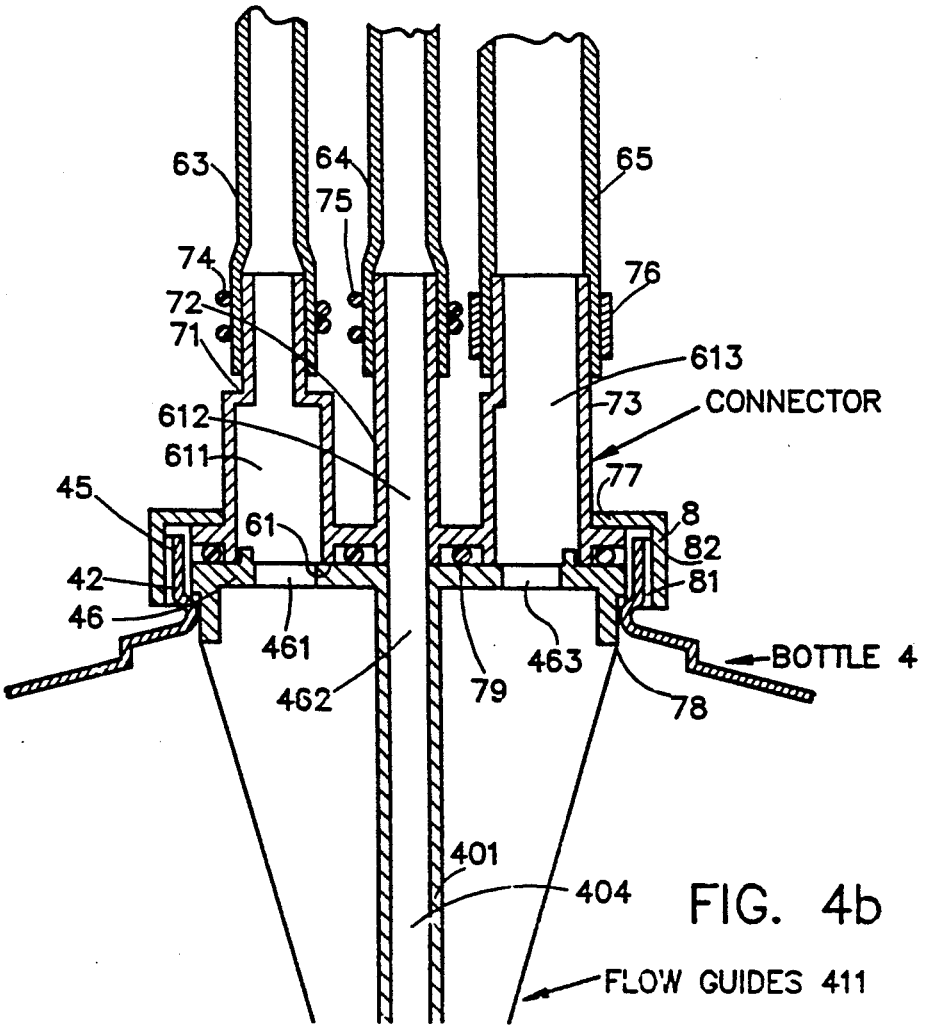
FIG. 4*b* is a cross sectional detail plan view showing the attachment of a container in accordance with the present invention to a machine surface for the purpose of interchanging fluids with the machine, which machine was previously seen in FIG. 3.

A detailed cross-sectional top view of upper surface 46 to bottle 4, and lower surface 61 to machine 6, is shown in FIG. 4*a*. A cross-sectional side view of the same regions is shown in FIG. 4*b*. The bottom surface 61 to machine 6 is part of a more substantial, three-dimensional, structure called a connector 7. The connector 7, which is normally molded of plastic, includes three upwardly-extending tubes 71, 72, 73 which respectively define ports 611, 612, 613 (previously seen in FIG. 3*b*). The tubes 71, 72, 73 respectively connect to venting fluid line 63, feed fluid line 64, and return fluid line 65 (previously seen in FIG. 2). The connection is normally made by tension clamps 74, 75, 76.

The connector 7 connects to bottle 4 so that the ports 611, 612, 613 are oppositely disposed to orifices 461, aperture 462, and orifice 463 on the top surface 61 of bottle 4 by use of collar, or ferrule, 8. The circular collar 8, which is in the shape of an annular ring, rotates about a central axis defined by central port 612 and central orifice 462, and is in sliding contact with an exterior circumferential lip surface 77 to connector 7. The interior of collar 8 presents screw threads 81 which engage complementary threads 42 on the neck 45 of bottle 4. The collar 8 preferably presents a knurled exterior surface 82 that presents friction to the hand, allowing the collar to be grasped and rotated by the fingers.

The screw tightening of collar 8 over the neck region 45 of bottle 4 presses the upper surface 46 of the bottle 4 into compressive contact with the lower surface 61 of machine 6. During the course of this compressive contact both an outer 0 ring 78 and an inner 0 ring 79 are compressed, forming a fluid-tight seal. The function of the 0 rings 78, 79 may alternatively be realized by a gasket. The 0 rings 78, 79, or the alternative gasket, are elastomeric, and are normally made of rubber.

The inner 0 ring 79, in particular, seals the central, suction, port 612 fluid-tight to the central aperture 462 and to the bore 404 of feed tube 401. Meanwhile, the outer O ring 78 seals the vent port 611, and the fluid return port 613, (i) in juxtaposition to respective orifices 461, 463, (ii) in separation from the central, suction, port 612 and aperture 462, and (iii) in separation from the external environment.

The orifice 461, and also the orifice 463, each preferably consists of three holes, as is most clearly visible in FIG. 4*a*. The three holes of orifice 461 are separated, in their radially circumferentially arrayed disposition around the central orifice 462, from the three holes of orifice 463 by oppositely-disposed barrier plates 711, 712 within the body of connector 7.

The barrier plates 711, 712—which are a feature of connector 7 only and which do not have a counterpart structure within the bottle 4—serve to isolate the three holes of orifice 461 from the three holes of orifice 463. Liquids 11, 12 that are returned from the machine 6 through its fluid return port 613 are circumferentially distributed around 180° of the upper surface 46 to bottle 4. The returned liquid may enter the bottle 4 through any of the three holes of orifice 463. The collective size of the three holes of orifice 463 is sufficient to accommodate the maximum rate of fluid flow.

Isolation of the fluid return port 613 from the vent port 611, and also of the fluid return orifice 463 from the vent orifice 461, helps to prevent bottle 4 from mixing fluid and air during the ingress of fluids thereto, and thereby helps to prevent oxidation of fluid developer 12.

A preferred electrical circuit for the control of the temperature of fluid developer 12 within a bottle 4 is shown in FIG. 5. A temperature sensor 52 (previously seen in FIG. 2) senses the temperature of fluid developer 12 within bottle 4. The sensor 52 is typically a chip type LM 3911 N. An input d.c. voltage appearing between signal lines V+ and V− is clamped by zener diode 521 to approximately 6.8 volts d.c. A sensor 522 produces an electrical signal in response to a sensed temperature. This electrical signal is amplified in amplifier 523 to produce an amplified differential output signal, suitable for transmission, between signal lines IN and OUT.

The sensor chip 52 plugs to a respective temperature control circuits 56 via connector 54. The temperature control circuit 56 contains a signal balancing and amplification section 561 followed by a relay driver circuit 562. A variable resistance 5611 within signal conditioning circuit 651 is manually adjustable in order to predetermine the temperature at which the fluid developer 12 within the bottle 4 will be held.

The temperature control circuit 56 functions, under the temperature signal derived from sensor chip 52, to selectively energize associated solid-state relay 58 at such times as the fluid developer 12 within the bottle 4 needs to be warmed. The solid-state relay 58 connects a.c. voltage to the heaters 50, 51 through a connector 581. The heaters 50, 51 are preferably blanket heaters, Minco type 5525-38.1. Other a.c. powered heaters of adequate wattage output may be used. The required wattage is a function of the volume of bottle 4 and its contained fluid developer 11, and of the ambient temperature of the environment in which such bottle 4 is maintained. Normally, however, an individual heater 50, 51 of 300 watts each will adequately suffice to heat over 3 liters of fluid developer 12 to an elevated temperature of 95.5° F. within 15 minutes.

In accordance with the preceding explanation, it will be recognized that, although the bottle 4 is preferably of unitary construction, the essential features and advantages of the invention could be realized by constructing the bottle 4 in two or more pieces. Diagrammatic representations of three bottles 400, 500, and 600 respectively constructed in one, two, and three pieces are respectively shown in FIGS. 6*a*, 6*b*, and 6*c*. Each bottle 400, 500 and 600 is possessed of (i) a body portion defining a reservoir for a liquid, (ii) a connector portion for attaching the body portion to a machine or other external device, and (iii) a conduit portion having an apertured surface for forming a sealed contact with the machine when the body is attached thereto by the connector portion.

Figure 6A:
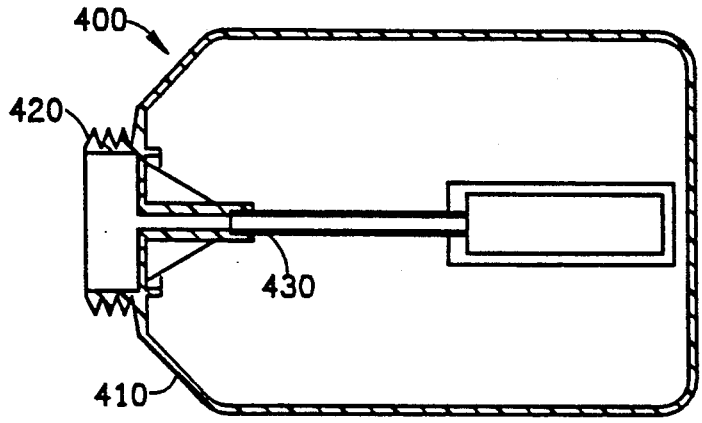
FIG. 6, consisting of FIG. 6*a*, 6*b* and 6*c*, is a diagrammatic representation of the disposable container in accordance with the present invention respectively implemented in a preferred unitary form, a two-piece form, and a three-piece form.

In the bottle 400 diagrammatically shown in FIG. 6*a* each of the body portion 410, the connector portion 420, and the conduit portion 430 is permanently affixed to the remaining portions, either by being integrally molded, thermoplastically fused, glued, or by other known methods of affixing plastics. In the bottle 500 diagrammatically shown in FIG. 6*b* the conduit portion 530 is detachable from the body portion 510 and the connector portion 520, which are affixed together. Finally, in the bottle 600 diagrammatically shown in FIG. 6*c* each of the body portion, 610, the connector portion 620 (which exhibits interior and exterior threads) and the conduit portion 630 are separate and detachable one from another.

Figure 6B:
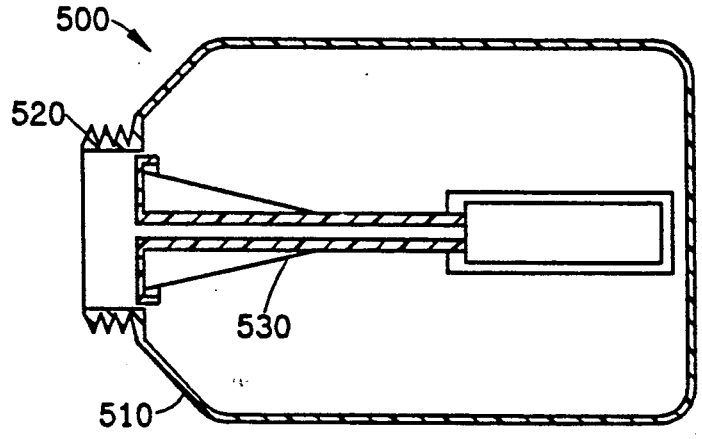
Figure 6C:
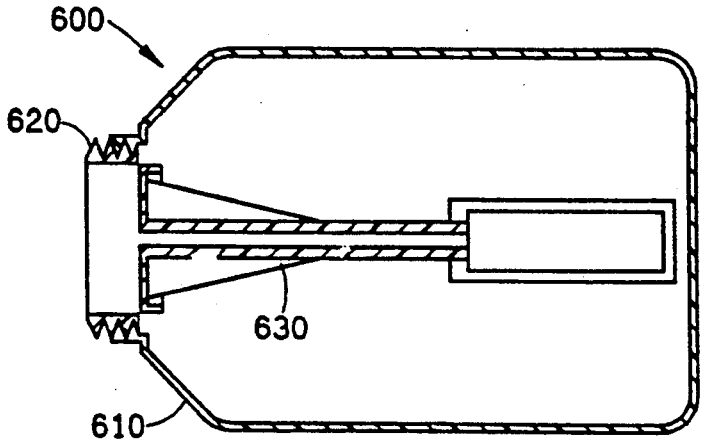

It is clear from FIGS. 6a through 6c that each of the bottles 400, 500, 600 could be transported and connected to a machine 6 (shown in FIG. 2) in order to function equivalently to the preferred embodiment of a unitary bottle 4 (shown in FIGS. 2 and 3) in accordance with the present invention. The following claims should therefore be interpreted to encompass containers, and fluid circulating systems, that are differently partitioned and interconnected in their structural elements from the preferred embodiment of a container in accordance with the present invention, at least so long as such interpretation does not expressly violate the variously claimed thermal, mechanical, and/or fluid-interchange connections that are supported by a container in accordance with the present invention.

Further in accordance with the preceding explanation, the several features of the present invention will be recognized to be susceptible of implementation in alternative forms. The liquid container need not be in the shape of a square bottle, nor even substantially regular. Its surfaces which make contact with external heating elements need not be planar, but only complementary in contour over an extended area with such external heating elements. The circular, and annular, geometries of the mating surfaces for the transfer of fluids are highly preferred. However, the dimensions, numbers of individual orifices, and partitionment between orifices devoted to venting and to fluid return, are, to some degree, variable.

Similarly, both the preferred material and the placement of the filter 6 are subject to variation. The filter 6 could be, for example, located entirely within the bore of feed tube 401. Also, the baffles 411 may be presented in an alternative configuration. For example, they could be tubular in form. However, the baffles 411 should be continuous in length in order to facilitate dripless fluid flow from the inlet orifices 461, 463 to the reservoir of bottle 4.

Finally, the collar 8 need not work exclusively by action of screw threads, but could, alternatively, be of a snap-lock type.

In accordance with these and other alterations and adaptations of the present invention, the invention should be interpreted in accordance with the following claims, only, and not solely in accordance with that preferred embodiment within which the invention has been taught.

What is claimed is:

1. A container for liquids, the container mountable to an external device presenting a mount, flow communicative with the external device through ports within a portal surface of the external device; and heatable by a heating surface of the external device, the container comprising:

a body substantially in the shape of a bottle, the body defining a liquid reservoir, a first surface in substantial conformity with the heating surface of the external device, a second surface defining ports in substantial correspondence with the ports of the external device's portal surface, a third surface for engaging the external mount so that the second surface is held tight to the external device's portal surface, with its ports in fluid-tight flow communication with the corresponding ports of the external device's portal surface and, wherein the body's second surface defines a central aperture that flow connects to the body's reservoir;

a first annular section, located about the central aperture, having an outer surface contour to which a fluid-tight compressive seal may be made;

a next outermost, second, annular section having at least one orifice that flow connects to the body's reservoir; and a next outermost, third, annular section having an outer surface contour to which a fluid-tight compressive seal may be made.

2. The container according to claim 1 wherein the body's first surface comprises and defines:

a substantially planar side wall to the reservoir.

3. The container according to claim 1 wherein the body's third surface comprises and defines:

screw threads.

4. A container for liquids that flow from a reservoir within the container to and from ports within an external surface to which the container is mountable, the container comprising:

a container body in the shape of a bottle defining a fluid reservoir;

at least one outer surface to the container body that is substantially complementary in its contour to a heated surface that is external to the container body;

an upper surface to the container body located at the upper regions thereof, the upper surface presenting (i) a central aperture, (ii) a first annular section, located about the central aperture, having an outer surface contour to which a first fluid-tight compressive seal may be made, (iii) a next outermost, second, annular section having at least one orifice that flow connects to the container body's reservoir, and (iv) a next outermost, third, annular section having an outer surface contour to which a second fluid-tight compressive seal may be made;

a tube within the container body flow-connecting the central aperture of the upper surface to the container body's reservoir;

mounting means for mounting the container body fluid-tight at the first and third annular sections of its top surface to an external surface of complementary contour defining parts, therein to exchange flowing fluids between the container body's reservoir and the parts of the external surface (i) through the central orifice of the upper surface that is flow-connected by the tube to the reservoir, and (ii) through the at least one orifice within the upper surface that also flow connects to the container body's reservoir.

5. The container according to claim 4 further comprising:

one or more baffle means, located within the container body between an underside of the upper surface's second annular section at a position proximate to at least one of the orifices thereof and the container body's reservoir, for guiding fluid that is received under force of gravity into the at least one orifice in a downwards direction to the container body's reservoir substantially without dripping.

6. The container according to claim 5 where in at least one of the one or more baffle means comprises:

a member extending between the underside of the upper surface and the tube within the container body for channelling the fluid received into the at least one orifice downwards to the exterior surface of the tube, from where it flows further downwards under force of gravity to the container body's reservoir;

wherein the member directs the fluid received under force of gravity into the at least one orifice in a downwards direction to the container body's reservoir substantially without dripping.

7. The container according to claim 4 wherein the container body's at least one outer surface comprises:

a substantially planar exterior surface that makes thermal contact with a substantially planar external heated surface.

8. The container according to claim 4 wherein the container body's upper surface comprises:

a substantially planar member permanently affixed to the container body and integral therewith.

9. The container according to claim 4 further comprising:

a filter within the container body and in a fluid path between the central aperture and the at least one orifice of the upper surface.

10. The container according to claim 9 wherein the filter comprises:

a porous plastic interposed in the fluid path between the bore of the tube and the container body's reservoir.

11. The container according to claim 10 wherein the porous plastic comprises:

polyethylene.

12. The container according to claim 4 wherein the container body comprises:

a plastic material.

13. The container according to claim 12 wherein the container body's upper surface comprises:

a plastic material affixed to the plastic container body.

14. The container according to claim 13 wherein the tube comprises:

a plastic material affixed to the container body's plastic upper surface in a position flow connecting to its central aperture.

15. The container according to claim 4 wherein the mounting means comprises:

a screw collar for detachably mounting the container to the complementary-contour external surface.

16. The container according to claim 4 wherein the upper surface's second annular section defines and comprises:

at least two orifices at a sufficient angular separation circumferentially spaced around the upper surface's second annular section;

wherein one or more of said orifices are usable to vent the container body's reservoir simultaneously with the other remaining orifices usable to receive flow of fluid under force of gravity into the container body's reservoir.

17. The container according to claim 16 wherein the angularly-separated at least two orifices of the upper surface's second annular section comprise:

a first orifice at a first angular position circumferentially spaced around the upper surface's second annular section; and a second orifice at a second angular position, separated approximately 180° from the first angular position, circumferentially spaced around the upper surface's second annular section.

18. A system for circulating fluid comprising:

a bottle comprising and defining a reservoir of fluid, a top surface to the bottle, which surface defines (i) an outlet aperture, (ii) a first region of prescribed contour about the outlet aperture, (iii) an inlet aperture flow connecting to the bottle's reservoir, and (iv) a second region of prescribed contour about the inlet aperture, a tube within the bottle that flow connects the outlet aperture of its top surface and its reservoir of fluid;

a machine comprising a bottom surface, complementary in its features to the bottle's top surface, defining (i) an inlet port opposite to the bottle's outlet aperture, (ii) a first region about the inlet aperture suitable to mate with the first region of prescribed contour about the bottle's outlet aperture, (iii) an outlet port opposite to the bottle's inlet aperture, and (iv) a second, region about the outlet aperture suitable to mate with the second region of prescribed contour about the bottle's input aperture, a fluid conduit between the bottom surface's inlet and outlet ports, and a pump for pumping fluid within the conduit so as to create a suction force at the bottom surface's inlet port; and mounting means for mounting the top surface of the bottle tight to the bottom surface of the machine so that (i) said opposing first and second regions of both surfaces are in fluid-tight contact while (ii) fluid circulates under suction force of the machine's pump in a continuous path from the bottle's reservoir through the bottle's tube, out the outlet port of the bottle's top surface, into the inlet port of the machine's bottom surface, through the fluid conduit, out the outlet aperture of the machine's bottom surface, into the inlet aperture of the bottle's top surface, and back to the bottle's reservoir.

19. The system according to claim 18 wherein the bottle further comprises:

a member extending between the inlet aperture of said top surface and said reservoir so that the circulating fluid entering the bottle at its top surface's inlet aperture will run down the member and into the reservoir under force of gravity without dripping.

20. The system according to claim 18 wherein the bottle further comprises:

a filter in the fluid flow path between said top surface inlet aperture and said top surface outlet aperture

21. The system according to claim 20 wherein the filter is located at a reservoir opening of a bore of the bottle's tube.

22. The system according to claim 18 further comprising:

elastomeric members, situated between the opposing first and second regions of the bottle's top and the machine's bottom surfaces, compressing under the tight mounting of the bottle to the machine by the mounting means so as seal fluid-tight the surfaces.

23. The system according to claim 22 wherein the elastomeric members comprise:

gaskets situated between said opposing first and second regions that are substantially circular in shape.

24. The system according to claim 18 further comprising:

a heating element in thermal communication with the bottle for heating the fluid within the reservoir.

25. The system according to claim 24 wherein the heating element comprises:

an electrically resistive heating pad.

26. The system according to claim 25 further comprising:

a temperature sensor in thermal communication with the bottle for sensing the temperature of the heated fluid within the reservoir; and a control circuit, responsive to the sensed temperature, for energizing the electrically resistive heating pad so as to maintain the temperature of the heated fluid within the reservoir at a predetermined level.

* * * * *

UNITED STATES PATENT AND TRADEMARK OFFICE

CERTIFICATE OF CORRECTION

PATENT NO. : 5,148,208

DATED : September 15, 1992

INVENTOR(S) : Klosterboer et al.

It is certified that error appears in the above-identified patent and that said Letters Patent is hereby corrected as shown below:

In the Abstract, line 3, after "development liquid," insert --particularly fluid developer,--.

Column 2, line 8, please change "bottle" to --bottles--.

Column 3, line 46, please change "2¼" to --2½--.

Column 14, claim 20, line 50, insert a period after "aperture"

Signed and Sealed this

Sixteenth Day of November, 1993

Bruce Lehman

*Attest:*

BRUCE LEHMAN

*Attesting Officer*

*Commissioner of Patents and Trademarks*